US010301569B2

(12) United States Patent
Saccomando et al.

(10) Patent No.: US 10,301,569 B2
(45) Date of Patent: May 28, 2019

(54) METHOD OF FRICTION CONTROL

(71) Applicant: The Lubrizol Corporation, Wickliffe, OH (US)

(72) Inventors: Daniel J. Saccomando, Sheffield (GB); Shawn Dickess, Cincinnati, OH (US); Jody A. Kocsis, Chagrin Falls, OH (US); Brent R. Dohner, Concord, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 15/025,757

(22) PCT Filed: Sep. 30, 2014

(86) PCT No.: PCT/US2014/058253
§ 371 (c)(1),
(2) Date: Mar. 29, 2016

(87) PCT Pub. No.: WO2015/048722
PCT Pub. Date: Apr. 2, 2015

(65) Prior Publication Data

US 2016/0222311 A1 Aug. 4, 2016

Related U.S. Application Data

(60) Provisional application No. 61/884,342, filed on Sep. 30, 2013.

(51) Int. Cl.

| | |
|---|---|
| ***C10N 40/25*** | (2006.01) |
| ***C10M 133/16*** | (2006.01) |
| ***C10M 133/56*** | (2006.01) |
| ***C10M 133/58*** | (2006.01) |

(52) U.S. Cl.
CPC ..... *C10M 133/58* (2013.01); *C10M 133/16* (2013.01); *C10M 133/56* (2013.01); *C10M 2215/086* (2013.01); *C10M 2215/28* (2013.01); *C10M 2215/30* (2013.01); *C10N 2040/25* (2013.01); *C10N 2220/021* (2013.01); *C10N 2230/04* (2013.01); *C10N 2230/06* (2013.01); *C10N 2240/04* (2013.01); *C10N 2240/10* (2013.01); *C10N 2240/104* (2013.01)

(58) Field of Classification Search
CPC ..... C10M 133/58; C10M 133/16; C10M 133/56; C10M 2215/086; C10M 2215/28; C10M 2215/30; C10N 2040/25; C10N 2220/021; C10N 2230/04; C10N 2230/06; C10N 2240/04; C10N 2240/10; C10N 2240/104
USPC ..... 508/287
See application file for complete search history.

(56) References Cited

U.S. PATENT DOCUMENTS

| | | | | |
|---|---|---|---|---|
| 3,903,005 | A | 9/1975 | Kablaoui et al. | |
| 5,266,081 | A * | 11/1993 | Avery | C10L 1/143 44/331 |
| 5,616,543 | A * | 4/1997 | Cook | C08F 8/30 508/239 |
| 2002/0091068 | A1* | 7/2002 | Loper | C07D 207/408 508/221 |
| 2008/0096776 | A1* | 4/2008 | Carrick | C10M 141/12 508/192 |

FOREIGN PATENT DOCUMENTS

| | | | |
|---|---|---|---|
| EP | 1151994 | A1 | 11/2001 |
| EP | 1518918 | A1 | 3/2005 |
| EP | 2554538 | A1 | 2/2013 |
| EP | 2557144 | A1 | 2/2013 |

* cited by examiner

*Primary Examiner* — James C Goloboy
(74) *Attorney, Agent, or Firm* — Samuel Laferty; Teresan Gilbert

(57) ABSTRACT

This invention relates to a method of lubricating an internal combustion engine comprising at least one of a crankcase, a gear and a wet-clutch, said method comprising supplying to said crankcase, gear, and wet-clutch a lubricating composition containing: (a) an oil of lubricating viscosity; and (b) a friction modifying additive which is the reaction product of a hydrocarbyl-substituted succinic anhydride and an acid-functionalized amine compound.

12 Claims, No Drawings

METHOD OF FRICTION CONTROL

CROSS REFERENCE TO RELATED APPLICATION

This application claims priority from PCT Application Ser. No. PCT/US2014/058253 filed on Sep. 30, 2014, which claims the benefit of U.S. Provisional Application No. 61/884,342 filed on Sep. 30, 2013.

FIELD OF INVENTION

The present invention relates to a method of friction control by lubricating an internal combustion engine comprising a crankcase and at least one of a gear and a wet-clutch with a lubricating composition.

BACKGROUND OF THE INVENTION

It is known that attempts have been made to produce a lubricant universally compatible with two-stroke and/or four-stroke internal combustion engines. The lubricants generally contain a number of different performance additives that are not necessarily designed for application in e.g., a four-stroke motorcycle engine where crankcase oil viscosity is required whilst also requiring properties compatible with extreme pressures and temperatures associated with a gearbox, transmission or clutch. Consequently, many additives have properties that adversely affect engine performance or fuel economy.

Kasai et al. (2003 JSAE/SAE International Spring Fuels & Lubricants Meeting, Yokohama, Japan, May 19-22, 2003, Paper title Effect of Engine Oil Additives on Motorcycle Clutch System (SAE2003-01-1956 or JSAE 20030105) discloses borated dispersant in combination with detergents or zinc dithiophosphate as being suitable for friction control. Kasai et al. further states that engine oils containing friction modifiers cannot be applied in a 4-stroke motorcycle engine because they decrease clutch capacity.

U.S. Pat. No. 6,525,004 discloses a composition containing a borated hydrocarbyl succinimide dispersant and a phosphorus compound for use in 2-cycle and small engine four-cycle engines.

It would be advantageous to have a method of lubricating an internal combustion engine with at least one of a crankcase, a gear, a transmission system and a wet-clutch while imparting friction control. The present invention provides a method of lubricating an internal combustion engine while imparting friction control.

SUMMARY OF THE INVENTION

The invention provides a method of lubricating an internal combustion engine comprising a crankcase and at least one of a gear and a wet-clutch, said method comprising supplying to said crankcase and at least one of the gear and wet-clutch a lubricating composition comprising: (a) an oil of lubricating viscosity; and (b) a friction modifying additive which is the reaction product of a hydrocarbyl-substituted succinic anhydride and an acid functionalized amine.

The disclosed technology provides a method of maintaining static friction in an internal combustion engine including a crankcase and at least one of a gear and a wet-clutch, the method including supplying to the crankcase and at least one of the gear and wet-clutch a lubricating composition including (a) an oil of lubricating viscosity; and (b) the reaction product of a hydrocarbyl-substituted succinic anhydride and an acid-functionalized amine compound.

The invention further provides the method disclosed herein in which the reaction product is a succinimide acid.

The invention further provides the method disclosed herein in which the hydrocarbyl-substituted succinic anhydride or reactive equivalent has the Formula (1):

Formula (1)

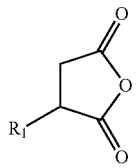

wherein $R^1$ is a hydrocarbyl group containing from 10 to 100 carbon atoms.

The invention further provides the method disclosed herein in which the hydrocarbyl substituent of the hydrocarbyl-substituted succinic anhydride includes a polyolefin.

The invention further provides the method disclosed herein in which the polyolefin includes an ethylene-propylene copolymer.

The invention further provides the method disclosed herein in which the hydrocarbyl substituent of the hydrocarbyl-substituted succinic anhydride comprises a polyisobutyl group.

The invention further provides the method disclosed herein in which the polyisobutyl group has a number average molecular weight of at least 400, or 500 or 800, from 800-3000, or 800-1,500.

The invention further provides the method disclosed herein in which the amine compound is an aryl compound.

The invention further provides the method disclosed herein in which the aryl compound is an amine-substituted benzoic acid or derivative thereof. The disclosed technology further provides the invention disclosed herein in which the amine compound having the Formula (2):

Formula (2)

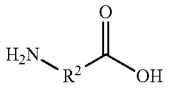

wherein $R^2$ is an alkylene or an aromatic group.

The invention further provides the method disclosed herein in which the amine compound is an aminosalicylic acid.

The invention further provides the method disclosed herein in which the aminosalicylic acid is 5-aminosalicylic acid.

The invention further provides the method disclosed herein in which the reaction product is present at 0.5 wt % to 1.2 wt %, or 0.1 wt % to 4 wt % or 0.25 wt % to 2 wt % of the lubricating composition.

The invention further provides the method disclosed herein in which wherein the lubricating composition is supplied to the crankcase and to the gear (or multiplicity of gears).

The invention further provides the method disclosed herein in which the lubricating composition is supplied to the crankcase and the wet clutch.

The invention further provides the method disclosed herein in which the lubricating composition is supplied to the crankcase and both the gear (or gears) and the wet clutch.

The invention further provides the method disclosed herein in which the lubricating composition further comprises an additional friction modifier for the reduction of dynamic friction, comprising one or more of an antiwear agent, a dispersant, a metal-containing detergent, a viscosity index improver, an antioxidant, an anti-foam, and a pour point depressant.

The invention further provides the method disclosed herein in which the internal combustion engine is a 4-stroke engine.

The invention further provides the method disclosed herein in which the 4-stroke engine is a motorcycle engine.

The invention further provides a lubricating composition for maintaining static friction in an internal combustion engine including a crankcase and at least one of a gear and a wet-clutch, the lubricating composition including an oil of lubricating viscosity, and a dispersant component including a hydrocarbyl-substituted succinic anhydride, the hydrocarbyl substituent of the hydrocarbyl-substituted succinic anhydride comprising an ethylene-propylene copolymer; and an acid-functionalized amine compound.

DETAILED DESCRIPTION OF THE INVENTION

This invention provides a method of lubricating an internal combustion engine comprising a crankcase and at least one of a gear and a wet-clutch, said method comprising supplying to said crankcase and at least one of the gear and wet-clutch a lubricating composition comprising: (a) an oil of lubricating viscosity; and (b) a friction modifying additive which is the reaction product of a hydrocarbyl-substituted succinic anhydride and an acid functionalized amine compound.

Internal Combustion Engine

The internal combustion engine of the invention comprises a crankcase, a gear and a wet-clutch. Optionally, the internal combustion engine further comprises a manual or automatic transmission. In one embodiment, the gear is from a gearbox.

As used herein, the term "wet-clutch" is known to a person skilled in the art as meaning one that contains a clutch plate(s) that is bathed or sprayed by a lubricant, e.g., that of the transmission, and the lubricating oil gets between the plate(s). In one embodiment, the wet clutch includes clutch plates and friction discs which are disposed in alternating order such that friction is developed between the disks and plates when pressure is applied axially.

In one embodiment, the internal combustion engine has a common oil reservoir supplying the same lubricating composition to the crankcase and at least one of a gear and a wet-clutch. In certain embodiments, the lubricating composition is supplied to the crankcase and to the gear (or multiplicity of gears), or to the crankcase and the wet clutch, or to the crankcase and both the gear (or gears) and the wet clutch.

In one embodiment, the internal combustion engine is a 4-stroke engine. In one embodiment the internal combustion engine is also referred to generically as a small engine.

The small engine in one embodiment has a power output of 2.24 to 18.64 kW (3 to 25 horsepower (hp)), in another embodiment 2.98 to 4.53 kW (4 to 6 hp) and in another embodiment exhibits 100 or 200 $cm^3$ displacement. Examples of small engines include those in home/garden tools such as lawnmowers, hedge trimmers or chainsaws.

In one embodiment, the internal combustion engine has a capacity of up to 3500 $cm^3$ displacement, in another embodiment up to 2500 $cm^3$ displacement and in another embodiment up to 2000 $cm^3$ displacement. Examples of suitable internal combustion engines with a capacity up to 2500 $cm^3$ displacement include motorcycles, snowmobiles, jet-skis, quad-bikes, or all-terrain vehicles. In one embodiment, the internal combustion engine is a tractor or other agricultural vehicle such as a combined harvester.

In one embodiment, the internal combustion engine is not a tractor or other agricultural vehicle. In another embodiment, the internal combustion engine does not contain a dry-clutch i.e., a system that separates the engine from the transmission such as a transmission on an automotive vehicle. In another embodiment, the internal combustion engine is not suitable for use with a diesel fuel.

In one embodiment, the internal combustion engine is a 4-stroke engine. In one embodiment, the internal combustion engine is suitable for motorcycles for example motorcycles with a 4-stroke internal combustion engine.

Oil of Lubricating Viscosity

The lubricating composition includes natural or synthetic oils of lubricating viscosity; oil derived from hydrocracking, hydrogenation or hydrofinishing; and unrefined, refined and re-refined oils, and mixtures thereof.

The fully formulated lubricant (including the component(s) that may be added as a top-treat or may be included by the manufacturer) will include, as one component, an oil of lubricating viscosity, also referred to as a base oil. The base oil may be selected from any of the base oils in Groups I-V of the American Petroleum Institute (API) Base Oil Interchangeability Guidelines, as set forth in Table 1:

TABLE 1

| Base Oil Category | Sulfur (%) | Saturates (%) | Viscosity Index |
|---|---|---|---|
| Group I | >0.03 and/or | <90 | 80 to 120 |
| Group II | ≤0.03 and | ≥90 | 80 to 120 |
| Group III | ≤0.03 and | ≥90 | >120 |
| Group IV | All polyalphaolefins | | |
| Group V | All others not included in Groups I, II, III or IV | | |

Groups I, II and III are mineral oil base stocks. The oil of lubricating viscosity can include natural or synthetic oils and mixtures thereof. Mixture of mineral oil and synthetic oils, e.g., polyalphaolefin oils and/or polyester oils, may be used.

Natural oils include animal oils and vegetable oils (e.g. vegetable acid esters) as well as mineral lubricating oils such as liquid petroleum oils and solvent-treated or acid treated mineral lubricating oils of the paraffinic, naphthenic, or mixed paraffinic-naphthenic types. Hydrotreated or hydrocracked oils are also useful oils of lubricating viscosity. Oils of lubricating viscosity derived from coal or shale are also useful.

Synthetic oils include hydrocarbon oils and halosubstituted hydrocarbon oils such as polymerized and interpolymerized olefins and mixtures thereof, alkylbenzenes, polyphenyl, alkylated diphenyl ethers, and alkylated diphenyl sulfides and their derivatives, analogs and homologues thereof. Alkylene oxide polymers and interpolymers and derivatives thereof, and those where terminal hydroxyl groups have been modified by, e.g., esterification or etherification, are other classes of synthetic lubricating oils. Other suitable synthetic lubricating oils comprise esters of dicarboxylic acids and those made from C5 to C12 monocarboxylic acids and polyols or polyol ethers. Other synthetic lubricating oils include liquid esters of phosphorus-containing acids, polymeric tetrahydrofurans, silicon-based oils such as poly-alkyl-, polyaryl-, polyalkoxy-, or polyaryloxy-siloxane oils, and silicate oils. Yet other synthetic oils include those produced by Fischer-Tropsch reactions, typically hydroisomerized Fischer-Tropsch hydrocarbons or waxes. In one embodiment, oils may be prepared by a Fischer-Tropsch gas-to-liquid synthetic procedure as well as other gas-to-liquid oils.

Unrefined, refined, and rerefined oils, either natural or synthetic (as well as mixtures thereof) of the types disclosed hereinabove can used. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils often are additionally processed to remove spent additives and oil breakdown products.

In one embodiment, the base oil is a Group II, a Group III, or a Group IV oil, or mixtures thereof. In one embodiment, the base oil is a Group II or a Group II or mixtures thereof. In one embodiment, the base oil is a Group II oil meaning at least 90% Group II. In one embodiment, the base oil is a Group III oil, meaning at least 90% Group III, or essentially Group II or essentially Group III.

The oil of lubricating viscosity in one embodiment is present from 40 wt % to 99.98 wt % of the lubricating composition, in another embodiment from 60 wt % to 99.87 wt % of the lubricating composition and in another embodiment from 69 wt % to 98.85 wt % of the lubricating composition.

Friction Modifying Additive

The friction modifying additive compounds of the present invention are prepared by reacting an acid functionalized amine compound (i.e., an amino acid) with a hydrocarbyl succinic acylating agent to form a succinimide acid.

The hydrocarbyl-substituted succinic acylating agents include the hydrocarbyl-substituted succinic acids, the hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents. Of these compounds, the hydrocarbyl-substituted succinic acids and the hydrocarbyl-substituted succinic anhydrides and mixtures of such acids and anhydrides are generally preferred, the hydrocarbyl-substituted succinic anhydrides being particularly preferred.

The acylating agent for producing the hydrocarbyl substituted acylating agent is made by reacting a polyolefin of appropriate molecular weight (with or without chlorine) with maleic anhydride. However, similar carboxylic reactants can be employed such as maleic acid, fumaric acid, malic acid, tartaric acid, itaconic acid, itaconic anhydride, citraconic acid, citraconic anhydride, mesaconic acid, methylmaleic anhydride, dimethylmaleic anhydride, ethylmaleic acid, dimethylmaleic acid, hexylmaleic acid, and the like, including the corresponding acid halides and lower aliphatic esters.

In one embodiment, they hydrocarbyl substituted succinic anhydride may be represented by the following formula:

Formula 1(a)

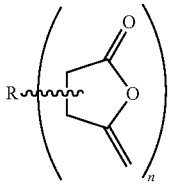

wherein R is a hydrocarbyl group; and n is equal to from 1 to 40 or from 1 to 2.

By hydrocarbyl it is meant any predominant hydrocarbon that has greater than or equal to one succinic anhydride or reactive equivalent thereof attached thereto. In some embodiments, the total number of "n" units is dependent on the molecular weight of the hydrocarbyl group. In one embodiment, where the molecular weight (Mn) of the hydrocarbyl group is greater than 3,000 but less than 20,000, n is equal to from 3 to 40; in another embodiment, where the molecular weight of the hydrocarbyl group is from 5,000 to 15,000 n is equal to from 3 to 7 or from 3 to 5; in a further embodiment, where the molecular weight of the hydrocarbyl group is greater than 20,000, n is equal to from 10 to 40, or from 12 to 30, or even from 15-25. In the formula 1(a), attachment of the hydrocarbyl group (R) is non-specific and may be achieved via one or more reaction pathwaysAttachment of the one or more succinic anhydride groups (or reactive equivalents) to the hydrocarbyl group (R) may be achieved in one or more of multiple methods. Direct attachment of the succinic acid may be achieved through ene reaction of an ethylenically unsaturated acylating acid (e.g. maleic anhydride) with high methylvinylidene content polyolefin; high vinylidene polyisobutylene may be commonly functionalized in this fashion. One or two succinc anhydride groups may be attached to low or mid vinylidene polyisobutylene through chlorination of the polymer, followed by diels alder condensation to form cyclic head groups with pendant succinic anhydride. Attachment of the one or more succinic anhydride groups may also be achieved through free radical grafting of a suitable succination agent (e.g. maleic anhydride) with a polyolefin, especially copolymers of ethylene and propylene.

In another embodiment, the hydrocarbyl substituted succinic anhydride may be represented by the following formula:

Formula 1(b)

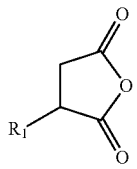

wherein $R^1$ is a hydrocarbyl group containing from 10 to 100 carbon atoms.

In one embodiment, the hydrocarbyl-substituted succinic anhydride can be a polyisobutylene succinimide where the polyisobutylene substituent of the friction modifier additive of the invention can have a number average molecular weight of at least 400, or at least 500, or at least 800, or from 800-3000, or from 800 to 1,500. A hydrocarbyl group is a univalent group that is predominately hydrocarbon in nature but it can have heteroatoms such as oxygen in the hydrocarbon chain and can have attached to the hydrocarbon chain nonhydrocarbon groups to include heteroatoms and heteroatom containing groups such as, for example, chlorine, a hydroxyl group or an alkoxy group.

In certain embodiments, the hydrocarbyl-substituted acylating agent is prepared by a process that involves the presence of small amounts of chlorine or other halogen, as described in U.S. Pat. No. 7,615,521, see, e.g., col. 4 and preparative example A. Such hydrocarbyl-substituted acylating agents typically have some carbocyclic structures in the attachment of the hydrocarbyl substituent to the acidic or amidic "head" group. In other embodiments, the hydrocarbyl-substituted acylating agent is prepared by a thermal process involving an "ene" reaction, without the use of any chlorine or other halogen, as described in U.S. Pat. No. 7,615,521; dispersants made in this manner are often derived from high vinylidene (i.e., greater than 50% terminal vinylidene) polyisobutylene. See col. 4, bottom, col. 5, and preparative example B. Such hydrocarbyl-substituted acylating agents typically do not contain the above-described carbocyclic structures at the point of attachment. In certain embodiments, the hydrocarbyl-substituted acylating agents is prepared by free radical catalyzed polymerization of high-vinylidene polyisobutylene with an ethylenically unsaturated acylating agent, as described in United States application U.S. 2008/0113889.

The hydrocarbyl-substituted acylating agent may be derived from, as the polyolefin, high vinylidene polyisobutylene, that is, having greater than 50, 70, or 75% terminal vinylidene groups ($\alpha$ and $\beta$ isomers). In certain embodiments, the hydrocarbyl-substituted acylating agent may be prepared by the direct alkylation route. In other embodiments, it may comprise a mixture of direct alkylation and chlorine-route dispersants.

In one embodiment, the hydrocarbyl-substituted acylating agent may be present as a single dispersant. In one embodiment, the hydrocarbyl-substituted acylating agent may be present as a mixture of two or three different hydrocarbyl-substituted acylating agents.

The hydrocarbyl-substituted acylating agent is generally derived from a polyolefin and an acylating agent. The polyolefin can be derived from one or more alkenes usually having 2 to 10 carbon atoms to include, for example, ethylene, propylene, isobutylene and mixtures thereof. The polyolefin can also be derived from mixtures of alkenes and dienes. In an embodiment of the invention, the polyolefin is a polyisobutylene, and in other embodiments the polyolefin is a conventional polyisobutylene having a vinylidene isomer content of 25% or less, a highly reactive polyisobutylene having a vinylidene isomer content of 50% or greater, or a mixture of a conventional and a highly reactive polyisobutylene. The acylating agent can comprise an alpha, beta-unsaturated mono- or polycarboxylic acid or derivative thereof, to include anhydrides and esters, such as, for example, acrylic acid, methyl acrylate, methacrylic acid, maleic acid or anhydride, fumaric acid, itaconic acid or anhydride, or mixtures thereof. The hydrocarbyl substituted acylating agent can be prepared by well-known methods to include heating a polyolefin and an acylating agent at elevated temperatures generally from 150° C. to 250° C., in the presence or absence of a promoter such as the halogen chlorine. In an embodiment of the invention, the hydrocarbyl substituted acylating agent is a polyisobutenylsuccinic anhydride.

Suitable polyolefins include ethylene, propylene, and butylene polymers, copolymers thereof, copolymers thereof further containing a non-conjugated diene, and isobutylene/conjugated diene copolymers, each of which can be subsequently supplied with grafted carboxylic functionality to serve as the linking group or have carboxylic functionality in the backbone itself (such as an ethylene-propylene-co-maleimide). In some embodiments, the polyolefin is an ethylene-olefin-based polymer, such as an ethylene propylene copolymer. In some embodiments, the olefin-based polymer is a copolymer where ethylene makes up at least 10% of the monomer used to prepare the copolymer on a molar basis, or at least 20 mole %, or at least 50 mole %.

Ethylene-propylene or higher alpha monoolefin copolymers may consist of 15 to 80 mole % ethylene and 20 to 85 mole % propylene or higher monoolefin. In some embodiments, the mole ratio is 30 to 80 mole % ethylene and 20 to 70 mole % of at least one $C_3$ to $C_{10}$ alpha monoolefin, for example, 50 to 80 mole % ethylene and 20 to 50 mole % propylene. Terpolymer variations of the foregoing polymers may contain up to 15 mole % of a non-conjugated diene or triene.

In these embodiments, the polyolefin (e.g., the ethylene copolymer or terpolymer), can be an oil-soluble, substantially linear, rubbery material. Also, in certain embodiments, the polymer can be in forms other than substantially linear, that is, it can be a branched polymer or a star polymer. The polymer can also be a random copolymer or a block copolymer, including di-blocks and higher blocks, including tapered blocks and a variety of other structures The polyolefin may have a number average molecular weight Mn (measured by gel permeation chromatography, using a polystyrene standard), which can be up to 150,000 or higher, e.g., at least 3,000 or at least 5,000, such as up to 150,000 or up to 120,000, or up to 100,000, or up to 50,000, or up to 15,000, e.g., about 3,000 to about 15,000. The acid-functionalized dispersant viscosity modifier may have a number average molecular weight Mn (by gel permeation chromatography, polystyrene standard), which can be up to 150,000 or higher, e.g., at least 3,000 or at least 5,000, such as up to 150,000 or up to 120,000, or up to 100,000, or up to 50,000, or up to 18,000, e.g., about 4,000 to about 16,000

The amino acid from which the succinimide acid is derived includes an aryl compound. The aryl compound can include aromatic and aliphatic amines. In one embodiment, the aryl compound comprises an aromatic amine. The amino acids used in the present invention can be represented by the following formula:

Formula (2)

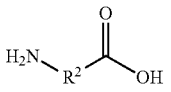

wherein $R^2$ is an alkylene or an aromatic group. In one embodiment, $R^2$ is an alkylene group containing at least one heteroatom such as an oxygen or a nitrogen atom. In one embodiment, the aromatic ring is an aryl group. In one embodiment, the aromatic group contains from 5-24 carbon atoms, or from 6-12 carbon atoms.

In one embodiment, suitable aromatic amino acids include those compounds wherein $R^2$ comprises an amine-substituted benzoic acid or derivatives thereof. Representative examples of aromatic amino acids useful in the present invention include 2-aminobenzoic acid, 3-aminobenzoic acid, 4-aminobenzoic acid, 4-(aminomethyl) benzoic acid, 2-amino-3-methylbenzoic acid, 2-amino-5-methylbenzoic acid, 2-amino-6-methylbenzoic acid, 3-amino-2-methylbenzoic acid, 3-amino-4-methylbenzoic acid, and 4-amino-2-methylbenzoic acid, 4-amino-2-hydroxybenzoic acid, 3-amino-2-hydroxybenzoic acid. In one embodiment, the aromatic amino acid is 5-amino-2-hydroxybenzoic acid (5-aminosalicylic acid).

In one embodiment, where $R^2$ is an aromatic group, the acid-functionalized amine compound may be represented by the following formula:

Formula 3

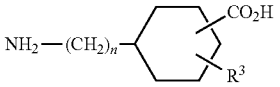

where $R^3$ is H, CH, or OH; and n is from 0 to 6.

In one embodiment, the friction modifying additive compound can be present in an amount from about 0.5 wt % to about 1.2 wt %, or from about 0.1 wt % to about 4 wt %, and in one embodiment from about 0.25 wt % to about to about 2 wt %.

Performance Additives

In one embodiment, the lubricant composition or lubricant concentrate includes at least one performance additive other than the succinimide acid friction modifier of the invention. The performance additive(s) can include at least one of metal deactivators, detergents, dispersants, extreme pressure agents, antiwear agents, antioxidants, corrosion inhibitors, foam inhibitors, demulsifiers, pour point depressants, viscosity modifiers, other friction modifiers, seal swelling agents and mixtures thereof. In one embodiment, the performance additives may be used alone or in combination with each other.

The total combined amount of the additional performance additives present may range from 0 wt. % to 30 wt. %, or from 1 wt. % to 25 wt. %, or from 2 wt. % to 20 wt. %, or from 3 wt. % to 10 wt. %, or from 4 wt % to 8 wt % of the lubricant composition. Although one or more of the performance additives may be present, it is common for the performance additives to be present in different amounts relative to each other.

In the case of a lubricant concentrate (which may be combined with additional oil to form, in whole or in part, a finished lubricant composition), the ratio of the various performance additives to the oil of lubricating viscosity and/or to diluent oil include the ranges of 80:20 to 10:90 by weight.

Friction modifiers in addition to the succinimide acid modifier of the present invention can include fatty amines, esters such as glycerol esters, fatty phosphites, fatty acid amides, fatty epoxides, borated fatty epoxides, alkoxylated fatty amines, borated alkoxylated fatty amines, esters and amides of α-hydroxycarboxylic acid compounds, metal salts of fatty acids, fatty imidazolines, condensation products of carboxylic acids and polyalkylene-polyamines, amine salts of alkylphosphoric acids, molybdenum dithiocarbamate or mixtures thereof.

Friction modifiers may also encompass materials such as sulfurized fatty compounds and olefins, molybdenum dialkyldithiophosphates, molybdenum dithiocarbamates, sunflower oil or monoester of a polyol and an aliphatic carboxylic acid.

In one embodiment, the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. In one embodiment, the friction modifier may be a long chain fatty acid ester. In another embodiment, the long chain fatty acid ester may be a mono-ester or a diester or a mixture thereof, and in another embodiment, the long chain fatty acid ester may be a triglyceride. The friction modifier may be present at 0 wt % to 6 wt %, or 0.05 wt % to 4 wt %, or 0.1 wt % to 2 wt %, or from 0.2 to 8 wt % of the lubricating composition.

Exemplary antioxidants useful as oxidation inhibitors include sulfurized olefins, hindered phenols, diarylamines (such as diphenylamines, e.g., alkylated diphenylamines), phenyl-alpha-naphthylamines, hindered phenol esters, molybdenum dithiocarbamates, and mixtures and derivatives thereof. Antioxidant compounds may be used alone or in combination.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment, the diphenylamine may include nonyl diphenylamine, dinonyl diphenylamine, octyl diphenylamine, dioctyl diphenylamine, or mixtures thereof. In one embodiment, the alkylated diphenylamine may include nonyl diphenylamine, or dinonyl diphenylamine. The alkylated diarylamine may include octyl, di-octyl, nonyl, di-nonyl, decyl or di-decyl phenylnapthylamines Sulfurized olefins are well known commercial materials, and those which are substantially nitrogen-free, that is, not containing nitrogen functionality, are readily available. The olefinic compounds which may be sulfurized are diverse in nature. They contain at least one olefinic double bond, which is defined as a non-aromatic double bond; that is, one connecting two aliphatic carbon atoms. These materials generally have sulfide linkages having 1 to 10 sulfur atoms, for instance, 1 to 4, or 1 or 2.

Ashless antioxidants may be used separately or in combination. In one embodiment of the invention, two or more different antioxidants are used in combination, such that there is at least 0.1 weight percent of each of the at least two antioxidants and wherein the combined amount of the ashless antioxidants is 0.5 to 5 weight percent. In one embodiment, there may be at least 0.25 to 3 weight percent of each ashless antioxidant.

The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

Exemplary detergents include neutral or overbased, Newtonian or non-Newtonian, basic salts of alkali, alkaline earth and transition metals with one or more of a phenate, a sulfurized phenate, a sulfonate, a carboxylic acid, a phosphorus acid, a mono- and/or a di-thiophosphoric acid, a saligenin, an alkylsalicylate, a salixarate or mixtures thereof. A neutral detergent has a metal:detergent (soap) molar ratio of approximately one. An overbased detergent has a metal:detergent molar ratio exceeding one, i.e., the metal content is more than that necessary to provide for a neutral salt of the detergent. In one embodiment, the lubricant composition comprises at least one overbased metal-containing detergent with a metal:detergent molar ratio of at least 3, and in one embodiment a molar ratio up to 1.5. The overbased detergent may have a metal:detergent molar ratio of at least 5, or at least 8, or at least 12. In one embodiment, the overbased detergent is a salicylate detergent.

In one embodiment, the alkali or alkaline earth metal overbased detergent comprises a calcium, sodium, or magnesium detergent, or combination thereof. In one embodiment, the metal detergent comprises a calcium detergent. The overbased detergent may be present at 0.1 wt % to 5 wt %, or 0.2 wt % to 3 wt %, or 0.4 wt % to 1.5 wt %.

Exemplary dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterized by a polar group attached to a relatively high molecular weight hydrocarbon chain. Typical ashless dispersants include succinimides, phosphonates, and combinations thereof.

Exemplary succinimide dispersants can include N-substituted long chain alkenyl succinimides as well as post-treated versions thereof. U.S. Pat. Nos. 3,215,707; 3,231,587; 3,515,669; 3,579,450; 3,912,764; 4,605,808; 4,152,499; 5,071,919; 5,137,980; 5,286,823; 5,254,649 describe methods for forming such dispersants and their components. Post-treated dispersants include those further treated by reaction with materials such as urea, boron, thiourea, dimercaptothiadiazoles, carbon disulfide, aldehydes, ketones, carboxylic acids, hydrocarbon-substituted succinic anhydrides, nitriles, epoxides and phosphorus compounds.

For example, such dispersants can be produced by reaction of a C3-C6 polyalkylene (e.g., polypropylene, polyisobutylene, polypentylene, polyheptylene) or derivative thereof (e.g., a chlorinated derivative) with a mono- or $\alpha/\beta$ unsaturated-dicarboxylic acid or anhydride thereof (such as maleic anhydride or succinic anhydride) to produce an acylated C3-C6 polyalkylene compound, which is reacted with an amine different than that of the present invention, such as a primary amine or a polyamine, such as a polyethylene amine, an aromatic amine or a polyether amine, to produce the dispersant.

Polyisobutylene (PIB) is known to exist in multiple aspects. Terminal vinylidene, also referred to as methyl vinylidene, moieties will react readily with acylating agents in the absence of a free radical initiator or halogen promoter. PIB with greater than 50% methylvinylidene content may be identified as high vinylidene. In one embodiment, the lubricating composition may include a dispersant derived from a high vinylidene polyisobutylene.

Other exemplary dispersants can be derived from polyisobutylene, an amine and zinc oxide to form a polyisobutylene succinimide complex with zinc.

In one embodiment, the ashless dispersant is boron-containing, i.e., has incorporated boron and delivers the boron to the lubricant composition. The boron-containing dispersant may be present in an amount that is sufficient to deliver at least 25 ppm boron, at least 50 ppm boron, or at least 100 ppm boron to the lubricant composition. In one embodiment, the lubricant composition is free of a boron-containing dispersant, i.e., delivers no more than 10 ppm boron or even less than 1 ppm boron to the final formulation.

Another class of ashless dispersant is acylated polyalkylene polyamines of the type described in U.S. Pat. No. 5,330,667.

Another class of ashless dispersants is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersant may be present at 0.1 wt % to 15 wt %, or 0.2 wt % to 10 wt %, or 0.5 wt % to 8 wt %, or 1.5 wt % to 6 wt % of the lubricating composition. In one embodiment, the lubricating composition comprises 0.1 to 1.6 weight %, or 0.25 to 1.2 weight % ashless dispersant. In one embodiment, the lubricating composition comprises less than 1 weight % of an ashless dispersant, different from that of the invention.

Another additive is an antiwear agent. Examples of antiwear agents include phosphorus-containing antiwear/extreme pressure agents such as metal thiophosphates, phosphoric acid esters and salts thereof, phosphorus-containing carboxylic acids, esters, ethers, and amides, and phosphites. In certain embodiments, a phosphorus antiwear agent may be present in an amount to deliver 0.01 to 0.2 or 0.015 to 0.15 or 0.02 to 0.1 or 0.025 to 0.08 percent phosphorus. Often the antiwear agent is a zinc dialkyldithiophosphate (ZDP).

Zinc dialkyldithiophosphates may be described as primary zinc dialkyldithiophosphates or as secondary zinc dialkyldithiophosphates, depending on the structure of the alcohol used in its preparation. In some embodiments, the compositions of the invention include primary zinc dialkyldithiophosphates. In some embodiments, the compositions of the invention include secondary zinc dialkyldithiophosphates. In some embodiments, the compositions of the invention include a mixture of primary and secondary zinc dialkyldithiophosphates. In some embodiments, component (b) is a mixture of primary and secondary zinc dialkyldithiophosphates where the ratio of primary zinc dialkyldithiophosphates to secondary zinc dialkyldithiophosphates (one a weight basis) is at least 1:1, or even at least 1:1.2, or even at least 1:1.5 or 1:2, or 1:10. In some embodiments, component (b) is a mixture of primary and secondary zinc dialkyldithiophosphates that is at least 50 percent by weight primary, or even at least 60, 70, 80, or even 90 percent by weight primary. In some embodiments, component (b) is free of primary zinc dialkyldithiophosphates.

Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; sulfurized olefins (such as sulfurized isobutylene), organic sulfides and polysulfides such as dibenzyldisulfide, bis-(chlorobenzyl) disulfide, dibutyl tetrasulfide, sulfurized methyl ester of oleic acid, sulfurized alkylphenol, dimercaptothiadiazoles, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described, for example, in U.S. Pat. No. 3,197,405).

Exemplary corrosion inhibitors can include octylamine octanoate, condensation products of dodecenyl succinic acid or anhydride and a fatty acid such as oleic acid with a polyamine; metal deactivators including derivatives of benzotriazoles, thiadiazoles such as dimercaptothiadiazole and its derivatives, 1,2,4-triazoles, benzimidazoles, 2-alkyldithiobenzimidazoles, and 2-alkyldithiobenzothiazoles. Add polyether compounds, such as PAGS derived from ethylene oxide, propylene oxides, including Synalox® (Dow) family of polyglycols. 100-120B.

Suitable foam inhibitors include silicones, copolymers of ethyl acrylate and 2-ethylhexylacrylate which optionally further include vinyl acetate; and demulsifiers including polyethylene glycols, polyethylene oxides, polypropylene oxides and (ethylene oxide-propylene oxide) polymers.

Pour point depressants, including esters of maleic anhydride-styrene, polymethacrylates, polyacrylates or polyacrylamides; and seal swell agents including Exxon Necton-37™ (FN 1380) and Exxon Mineral Seal Oil (FN 3200); may also be used in the exemplary lubricant composition or lubricant concentrate.

In one embodiment, the exemplary lubricant composition or lubricant concentrate is free of sulfurized olefins and amine phosphates. By "free," it is meant that these ingredients, individually or in combination, amount to less than 0.01%, less than 0.001%, or even 0% of the lubricant composition.

INDUSTRIAL APPLICATION

In one aspect of the exemplary embodiment, a method of increasing static friction in an internal combustion engine without raising, or minimizing, or at least maintaining dynamic friction may include contacting a contact surface of the internal combustion engine with the exemplary lubricant composition. The contact surface may include at least one of a steel surface and a steel alloy surface or an aluminum surface or an aluminum alloy surface. The lubricant composition may be interposed between the contact surface and a second surface which, during operation of the internal combustion engine, moves relative to the contact surface.

In another aspect, the lubricant composition is used in an internal combustion engine which includes first and second sliding members in sliding contact, each sliding member defining a respective sliding surface, at least one of which slides relative to the other sliding surface. At least one of the sliding surfaces is formed from steel (or alloy of steel) or a diamond-like carbon (DLC) material, or combination thereof. A lubricant composition is interposed between the sliding surfaces to lubricate them during sliding. The lubricant composition includes an oil of lubricating viscosity and the reaction product of hydrocarbyl-substituted succinic anhydride and an amino acid to maintain static friction.

A steel alloy is an alloy in which steel is alloyed with one or more elements in total amounts between 1.0% and 50% by weight, typically to improve its mechanical properties. Accordingly, the exemplary steel surface or steel alloy surface contains at least 50 wt. % iron. Exemplary elements used in forming steel alloys may be selected from manganese, nickel, chromium, molybdenum, vanadium, silicon, boron, aluminum, cobalt, copper, cerium, niobium, titanium, tungsten, tin, zinc, lead, zirconium, and combinations thereof.

Diamond-like carbon surfaces may be formed, for example, according to the methods disclosed in U.S. Pub. No. 20110028361, and references cited therein, the disclosures of which are incorporated herein by reference in their entireties.

Gears are typically of an iron-based alloy and in some embodiments may be subjected to a carburizing treatment or a carbonitriding treatment. The kind of the iron-based alloy which constitutes the gear may be suitably selected according to use of the gear. As the iron-based alloy, ones which cannot be softened having a toughness at a temperature (around 200 C) during a film formation treatment and be heat-treatable are suitable. Typical examples of the iron-based alloy are carbon case hardening steels for machine structural use, such as S09CK, S15CK, S20CK and the like, and alloy case hardening steels for machine structural use, for example, nickel-chromium based alloys such as SNC415, SNC815 and the like, nickel-chromium-molybdenum based alloys such as SNCM220, SNCM415, SNCM420, SNCM616, SNCM815 and the like, chromium-based alloys such as SCr415, SCr420 and the like, chromium-molybdenum based alloys such as SCM 415, SCM418, SCM420, SCM421, SCM 822 and the like, and manganese based and manganese-chromium based alloys such as SMn420, SMnC420 and the like. The above examples of the alloys are suitably used as the iron-based alloy of the gear of the present invention. The above-mentioned symbols (such as S09CK) of the above alloys are according to the Japanese Industrial Standard.

The method and exemplary lubricant composition may be supplied to a mechanical device, such as an engine of a motorcycle, and used for lubrication of at least one of a gear and wet-clutch during normal operation of the mechanical device.

In several embodiments, a suitable lubricant composition includes the components present (on an actives basis) in ranges as shown Table 1.

TABLE 1

| | Embodiments (wt. % of lubricant composition) | | |
|---|---|---|---|
| | A | B | C |
| Friction modifying additive | 0.01-2 | 0.1-1 | 0.3-0.6 |
| Other Performance Additives | 0-20 | 0.5-20 | 4-15 |
| Oil of Lubricating Viscosity | 30-99 | 40-98 | 60-95 |
| Total of components | 100 | 100 | 100 |

EXAMPLES

Preparative Example 1(PREP1)

A 2 L 4-neck flask equipped with a mechanical stirrer, thermowell, sub-surface nitrogen inlet, and Dean-Stark trap with condenser is charged with 1000Mn polyisobutylene substituted with succinic anhydride (600 g) and diluent oil (600 g). This mixture is then stirred and heated to 150° C. 5-aminosalicyclic acid (79.6 g) is added over 1.5 hours and then the reaction temperature is increased to 170° C. and held for a further 5.5 hours. At this point, the reaction mixture is cooled and used without further purification.

Preparative Example 2(PREP2)

A 3-L, 4-neck flask equipped with a mechanical stirrer, thermocouple, subsurface $N_2$ line, and Dean Stark trap connected to a water-cooled condenser was charged with a succinated ethylene-propylene copolymer (available commercially as Lucant™ A-5320H polymer, an amorphous copolymer of ethylene and propylene (GPC Mn=7700) that is randomly grafted with maleic anhydride to a level of 3 weight % maleic anhydride) (900.0 g) and diluent oil (944.1 g). Contents of the flask were stirred and heated to 100° C. under flow of 0.5 scfh $N_2$. Aminomethyl benzoic acid (50.0 g) was added to the flask and the flask temperature increased to 160° C. Contents of the flask were stirred at 160° C. for 3 h. After 3 h an additional charge of aminomethyl benzoic acid (5.0 g) was added to the flask and the contents stirred for 8 h. Contents of the flask were filtered thru diatomaceous earth, providing the product (1875.8 g) as a viscous oil.

Example 1

A composition is prepared by blending additives as shown in Table 1 into a lubricant. The amounts in Table 1 are presented on an oil-free basis.

TABLE 1

| Additive (wt %) | Baseline | Inventive Example 1 | Comparative Example 1 |
|---|---|---|---|
| PREP1 | 0 | 0.75 | 0 |
| Oleyl amide | 0 | 0.1 | 0.1 |

Friction Test

The lubricant compositions were subjected to a clutch system friction test as described in JASO T904:2006 using an SAE #2 friction test machine. Wet clutch performance is measured by assessing the lubricating composition's frictional behavior relative to high friction (JAFRE A) and low friction (JAFRE B) reference oils as a modified SAE #2 friction test for motorcycle applications. The test evaluates three main clutch parameters: static friction, relating to clutch slip; dynamic friction relating to clutch feel/uptake; and stop time, relating to synchronization time. A clutch performance index is then assigned to the lubricating composition, which can be classified as JASO MA, MA1, or MA2 (high friction suitable for wet clutch applications, or JASO MB (low friction, more suited to dry clutch applications. For a lubricating composition to claim JASO MA2, all indices must fall within the values specified for the category as set forth below in Table 2:

TABLE 2

| Parameter | Index | JASO MA2 |
|---|---|---|
| Dynamic friction index | DFI | $1.8 \leq DFI < 2.5$ |
| Static friction index | SFI | $1.7 \leq SFI < 2.5$ |
| Stop time index | STI | $1.9 \leq STI < 2.5$ |

The testing results obtained were as follows in Table 3:

TABLE 3

| Parameter | Baseline | Inventive Example 1 | Comparative Example 1 |
|---|---|---|---|
| DFI | 1.90 | 2.35 | 1.88 |
| SFI | 1.92 | 1.76 | 1.42 |
| STI | 1.95 | 2.22 | 1.91 |

Overall the results show that the presence of the friction modifying additive of the invention in a lubricating composition for an internal combustion engine with at least one of a crankcase, a gear and a wet-clutch, provides a increased static friction without raising, or minimizing, or at least maintaining dynamic friction, while meeting JASO MA2 specifications.

In this specification, the terms "hydrocarbyl substituent" or "hydrocarbyl group," as used herein are used in its ordinary sense, which is well-known to those skilled in the art. Specifically, it refers to a group primarily composed of carbon and hydrogen atoms and attached to the remainder of the molecule through a carbon atom and which does not exclude the presence of other atoms or groups in a proportion insufficient to detract from the molecule having a predominantly hydrocarbon character. In general, no more than two, in one aspect no more than one, non-hydrocarbon substituent will be present for every ten carbon atoms in the hydrocarbyl group; typically, there will be no non-hydrocarbon substituents in the hydrocarbyl group. A more detailed definition of the terms "hydrocarbyl substituent" or "hydrocarbyl group," is provided in U.S. Pat. No. 6,583,092.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

What is claimed is:

1. A method of maintaining static friction in an internal combustion engine comprising a crankcase and at least one of a gear and a wet-clutch, the method comprising supplying to the crankcase and at least one of the gear and wet-clutch a lubricating composition comprising:

(a) an oil of lubricating viscosity; and (b) the reaction product of a hydrocarbyl-substituted succinic anhydride or reactive equivalent having the Formula (1):

Formula (1)

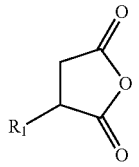

wherein $R^1$ is a hydrocarbyl group of number average molecular weight of 800 to 1500 g/mole and an-amine-substituted benzoic acid or derivative thereof, and wherein the reaction product is present at about 0.25 wt. % to about 2 wt. % of the lubricating composition, including the step of lubricating said internal combustion engine and at least one of said gear and a wet-clutch with said lubricating composition, wherein the internal combustion engine is not suitable for use with diesel fuel.

2. The method of claim 1, wherein the amine substituted benzoic acid or derivative thereof is an aminosalicylic acid.

3. The method of claim 2, wherein the aminosalicylic acid is 5-aminosalicylic acid.

4. The method of claim 2, wherein the hydrocarbyl substituent of the hydrocarbyl-substituted succinic anhydride comprises a polyolefin.

5. The method of claim 4, wherein the polyolefin comprises an ethylene-propylene copolymer.

6. The method of claim 2, wherein the hydrocarbyl substituent of the hydrocarbyl-substituted succinic anhydride comprises a polyisobutyl group.

7. The method of claim 1, wherein the lubricating composition is supplied to the crankcase and to at least one gear.

8. The method of claim 1, wherein the lubricating composition is supplied to the crankcase and the wet clutch.

9. The method of claim 1, wherein the lubricating composition is supplied to the crankcase and both at least one gear and the wet clutch.

10. The method of claim 1, wherein the lubricating composition further comprises an additional modifier comprising one or more of an antiwear agent, a dispersant, a metal-containing detergent, a viscosity index improver, an antioxidant, an anti-foam, and a pour point depressant.

11. The method of claim 1, wherein the internal combustion engine is a 4-stroke engine.

12. The method of claim 11, wherein the 4-stroke engine is a motorcycle engine.

* * * * *